US005612280A

United States Patent [19]

Takahashi et al.

[11] Patent Number: 5,612,280

[45] **Date of Patent: *Mar. 18, 1997**

[54] THERMOSENSITIVE RECORDING MATERIAL

[75] Inventors: Yoshiyuki Takahashi, Kawasaki; Ayako Shirai, Yokohama; Takako Segawa, Machida; Kunitaka Toyofuku, Sakura, all of Japan

[73] Assignee: New Oji Paper Co., Ltd., Tokyo, Japan

[ * ] Notice: The portion of the term of this patent subsequent to May 24, 2011, has been disclaimed.

[21] Appl. No.: 165,887

[22] Filed: Dec. 14, 1993

[30] Foreign Application Priority Data

Dec. 18, 1992 [JP] Japan ..... 4-338557
Mar. 10, 1993 [JP] Japan ..... 5-049403

[51] Int. Cl.[6] ..... B41M 5/30

[52] U.S. Cl. ..... 503/216; 503/225

[58] Field of Search ..... 427/150–152; 503/216, 225

[56] References Cited

U.S. PATENT DOCUMENTS

| | | | |
|---|---|---|---|
| 4,531,139 | 7/1985 | Seitz . | |
| 5,314,859 | 5/1994 | Takahashi et al. | 503/207 |

FOREIGN PATENT DOCUMENTS

| | | |
|---|---|---|
| 0503856A1 | 9/1992 | European Pat. Off. . |
| 0512560A1 | 11/1992 | European Pat. Off. . |
| 0535887A1 | 4/1993 | European Pat. Off. . |
| 43-4160 | 2/1968 | Japan . |
| 45-14039 | 5/1970 | Japan . |
| 48-27736 | 4/1973 | Japan . |
| 56-146794 | 11/1981 | Japan . |
| 58-199189 | 11/1983 | Japan . |
| 59-114096 | 6/1984 | Japan . |
| 59-167292 | 9/1984 | Japan . |
| 60-78782 | 5/1985 | Japan . |
| 62-19485 | 1/1987 | Japan . |
| 62-164579 | 7/1987 | Japan . |
| 62-169681 | 7/1987 | Japan . |
| 59-93387 | 5/1989 | Japan . |
| 5-221144 | 8/1993 | Japan . |
| 5-286253 | 11/1993 | Japan . |

OTHER PUBLICATIONS

Chemical Abstracts, vol. 120, No. 22, May 30, 1994, Abstract No. 285100p; p. 1000.
Chemical Abstracts, vol. 120, No. 6, Feb. 7, 1994, Abstract No. 65970g, p. 835.
Patent Abstracts of Japan, vol. 12, No. 10, Jan. 13, 1988. Abstract of JP 62–170388, Jun. 27, 1987.

*Primary Examiner*—B. Hamilton Hess
*Attorney, Agent, or Firm*—Armstrong, Westerman, Hattori, McLeland & Naughton

[57] ABSTRACT

A thermosensitive recording material having a high whiteness and capable of forming clear colored images with an excellent resistance to oil and plasticizers is provided with a thermosensitive colored image-forming layer formed on a substrate sheet and comprising a substantially colorless dye precursor, a binder and a color-developing agent comprising at least one aromatic compound among the formulae (II), (III) and (IV):

$$(R^1-SO_2NH\underset{\underset{X}{\|}}{C}NH)_n-A \quad \text{(II)}$$

$$(R^2-SO_2NH\underset{\underset{X}{\|}}{C}NH)_n-E \quad \text{(III)}$$

$$(R^3-SO_2NH\underset{\underset{X}{\|}}{C}NH)_n-A \quad \text{(IV)}$$

wherein X is an oxygen or sulfur atom, A represents a multivalent group, E represents a multivalent group having at least one aromatic cyclic group, and n represents an integer of 2 or more.

6 Claims, No Drawings

THERMOSENSITIVE RECORDING MATERIAL

BACKGROUND OF THE INVENTION

1. Field of the Invention

The present invention relates to a thermosensitive recording material on which colored images are formed by heating. More particularly, the present invention relates to a thermosensitive recording material capable of forming thereon colored images resistant to fading and thus exhibiting a high degree of persistency during extended storage thereof.

The thermosensitive recording material of the present invention is capable of recording thereon colored images exhibiting an excellent resistance to moisture, heat, oily and fatty substances, and plasticizers, and thus has superior persistency when stored over a long period of time and a high whiteness, and therefore is useful as colored image-recording sheets, sheets for use in facsimiles, word processors, CRT image printers and cash dispensers, as passenger tickets, commuter passes, labels such as POS labels, cards such as prepaid cards, and as transit passes.

2. Description of the Related Arts

It is known that a conventional thermosensitive recording material comprises a supporting substrate, for example, a paper sheet, synthetic paper sheet, or plastic resin film and a thermosensitive colored image-forming layer formed on a surface of the supporting substrate and comprising an electron-donative dye precursor, for example, a leuco basic dye, an electron-acceptive color-developing agent consisting of an organic acid substance, for example, a phenolic compound, and a binder. When the thermosensitive colored image-forming layer is heated imagewise, colored images are recorded thereon by a reaction of the dye precursor with the color-developing agent.

This type of thermosensitive recording material is disclosed in Japanese Examined Patent Publication Nos. 43-4,160 and 45-14,039 and Japanese Unexamined Patent Publication No. 48-27,736, and is widely employed in practice.

Namely, the thermosensitive recording material is advantageous in that colored images can be easily formed by heating alone, and the recording apparatus can be made compact and small in size, has a relatively low price, and can be easily maintained. Therefore, this type of thermosensitive recording material is appreciated as a useful information-recording material for recording outputs of printers used with, for example, computers, facsimile machines, automatic ticket-vending machines, scientific measurement recorders, and CRT medical measurement recorders.

Nevertheless, the conventional dye-forming type thermosensitive recording materials in which the thermosensitive colored image-forming layer comprises a conventional color-developing agent together with the dye precursor and the binder is disadvantageous in that the resultant colored images fade with the lapse of time, presumably because of a reversible reaction of the dye precursor with the color-developing agent. This fading of the colored images is accelerated by exposure to light, high temperatures, and high humidity and is specifically promoted by contact with an oily or fatty substance or a plasticizer, to such an extent that the faded images cannot be recognized.

Many attempts have been made to retard or inhibit the fading of the colored images formed on a conventional thermosensitive colored image-forming layer containing a substantially colorless dye precursor comprising a lactone ring compound. For example, Japanese Unexamined Patent Publication Nos. 60-78,782, 59-167,292, 59-114,096 and 59-93,387 disclose a thermosensitive colored image-forming layer containing a phenolic antioxidant.

Japanese Unexamined Patent Publication No. 56-146,794 discloses a protective layer formed from a hydrophobic polymeric compound emulsion on a thermosensitive colored image-forming layer.

Japanese Unexamined Patent Publication No. 58-199,189 discloses formation of both an intermediate layer and a top layer on a thermosensitive colored image-forming layer; the former being formed from a water-soluble polymeric compound solution or a hydrophobic polymeric compound emulsion and the latter being formed from a solvent-soluble hydrophobic polymer on the intermediate layer.

Japanese Unexamined Patent Publication No. 62-164,579 discloses a thermosensitive colored image-forming layer containing an epoxy compound in addition to a phenolic color-developing agent.

Japanese Unexamined Patent Publication No. 62-169,681 discloses metal salts of specific salicylic acid derivatives usable as a color-developing agent.

Japanese Unexamined Patent Publication No. 62-19,485 discloses that a compound having a certain chemical structure similar to that of the present invention is usable as a material for mainly pressure-sensitive recording paper sheets.

In the thermosensitive colored image-forming layer containing the phenolic antioxidant, the resultant colored images exhibit a higher resistance to heat and moisture to a certain extent compared to the colored images formed on a conventional colored image-forming layer free from the phenolic antioxidant, but the improvement effect of the phenolic antioxidant is not satisfactorily high. Also, the phenolic antioxidant does not have the capability to enhance the resistance of the colored images to the oily or fatty substances, for example, salad oil, and plasticizers, for example, dioctyl phthalate. The resistance of the colored images to oily or fatty substance or a plasticizer is determined in such a manner that the colored images are brought into contact with an oily or fatty substance, for example, a salad oil or a plasticizer, and left in contact therewith for a predetermined time, and then a retention of the color density of the tested colored images is measured in comparison with an initial color density thereof.

When the protective layer or the intermediate and top layers are formed on the thermosensitive colored image-forming layer, the resultant colored images exhibit a significantly enhanced persistency when the salad oil or the dioctyl phthalate is brought into contact with the colored image-forming surface of the recording material. Nevertheless, when the salad oil or the dioctyl phthalate is brought into contact with an edge face of the recording material, it penetrates the inside of the recording material and causes a complete fading of the colored images. Therefore, the provision of the protecting layer or the intermediate and top layer cannot completely eliminate the undesirable color-fading of the images.

The addition of the epoxy compound to the phenolic color-developing agent, is not totally appreciated, because it takes a long time to stabilize the colored images formed on the colored image-forming layer after a heat-recording operation, and therefore, if salad oil, or a plasticizer is brought into contact with the colored image-forming layer immediately after the heat-recording operation, the resultant colored images fade to a great extent.

The addition of the metal salts of the specific salicylic acid derivative to the colored image-forming layer effectively enhances the resistances of the colored image-forming layer to the oily or fatty substances and to the plasticizers. When the resultant thermosensitive recording sheet is subjected to a colored image-recording procedure and then to a heat resistance test, however, an undesirable color-development occurs on non-image-formed white portions of the recorded sheet. Also, the utilization of the specific salicylic acid derivative metal salts is disadvantageous in that this chemical has a complicated chemical structure and thus is expensive.

The compound disclosed in Japanese Unexamined Patent Publication No. 62-19,485 and having a certain chemical structure similar to that of the present invention, exhibits a color-developing activity equal to or lower than that of the conventional phenolic color-developing compounds. Also, the thermosensitive recording paper sheet prepared by using the abovementioned material is disadvantageous in that the colored images formed thereon are easily faded when brought into contact with salad oil or a plasticizer, as shown in Comparative Examples 3 and 4 hereinafter.

SUMMARY OF THE INVENTION

An object of the present invention is to provide a thermosensitive recording material capable of forming colored images thereon having excellent resistance to oily and fatty substances, plasticizers, moisture, and heat, and thus exhibiting superior persistency over a long time, and a high whiteness.

Another object of the present invention is to provide a thermosensitive recording material useful for thermorecording type tickets of automatic ticket-vending machines, commuter passes, and coupon tickets, which must have high persistency of the colored images recorded thereon, and for label sheets to be used in a POS bar code price-indicating system in which the label sheets are frequently attached to a surface of a polyvinyl chloride film containing a plasticizer and for wrapping fresh food or meat containing an oily or fatty substance; the label sheets of which are unavoidably brought into contact with the plasticizer and/or oily or fatty substance.

A further object of the present invention is to provide a thermosensitive recording material useful as facsimile recording sheets, word processor recording sheets, and CRT image printing sheets, which all must have high persistency of colored images recorded thereon.

The above-mentioned objects can be attained by the thermosensitive recording material of the present invention, which comprises a sheet substrate and a thermosensitive colored image-forming layer formed on a surface of the sheet substrate and comprising a substantially colorless dye precursor, a color-developing agent reactive with the dye precursor upon heating to thereby develop a color, and a binder, the color-developing agent comprising at least one aromatic compound having, per molecule thereof, at least two functional groups of the formula (I):

$$-SO_2NHC(=X)NH- \quad \text{(I)}$$

in which X represents a member selected from the group consisting of oxygen and sulfur atoms.

The aromatic compound having at least two functional groups of the formula (I) per molecule thereof can be selected from the group consisting of:

(A) aromatic compounds of the formula (II):

$$(R^1-SO_2NHC(=X)NH)_n-A \quad \text{(II)}$$

in which X is as defined above, $R^1$ represents an aromatic group substituted with at least one substituent selected from the group consisting of nitro group, alkyl groups substituted with at least one halogen atom, alkyloxy groups, aryloxy groups, aralkyloxy groups, alkyl-carbonyl groups, alkenyl groups, alkynyl groups, cycloalkyl groups, aryl groups and aralkyl groups, A represents a multivalent group and n represents an integer of 2 or more;

(B) aromatic compounds of the formula (III):

$$(R^2-SO_2NHC(=X)NH)_n-E \quad \text{(III)}$$

in which X is as defined above, $R^2$ represents a member selected from alkyl group, cycloalkyl groups, alkenyl groups, alkynyl groups, alkyl groups having at least one hereto atom contained in the backbone chain thereof, cycloalkyl groups having at least one hereto atom contained in the cyclic chain thereof, and alkenyl groups having at least one hetero atom contained in the backbone chain thereof, E represents a multivalent group having at least one aromatic cyclic group, and n is as defined above;

(C) aromatic compound of the formula (IV):

$$(R^3-SO_2NHC(=X)NH)_n-A \quad \text{(IV)}$$

in which X is as defined above, $R^3$ represents a member selected from the group consisting of aralkyl groups; substituted aralkyl groups having a hetero atom-containing aliphatic hydrocarbon moiety in which at least one methylene group is replaced by at least one hetero atom; substituted aralkyl groups having a substituted aromatic hydrocarbon moiety in which at least one member selected from the group consisting of substituent atoms other than hydrogen atom and substituent group is attached to an aromatic hydrocarbon moiety; and substituted aralkyl groups having a hetero atom-containing aliphatic hydrocarbon moiety in which at least one methylene group is replaced by at least one hetero atom, and a substituted aromatic hydrocarbon moiety in which at least one member selected from the group consisting of substituent atoms other than hydrogen atom and substituent groups is attached to the aromatic hydrocarbon moiety, A represents a multivalent group and n is as defined above; and (D) aromatic compounds having, per molecule thereof, an aromatic cyclic group and at least two functional groups of the formula (V):

$$R^4-SO_2NHC(=X)NH- \quad \text{(V)}$$

wherein X is as defined above, and $R^4$ represents a member selected from the group consisting of unsubstituted aromatic groups and substituted aromatic groups having at least one substituent selected from the group consisting of alkyl groups with 1 to 4 carbon atoms and halogen atoms, the functional groups of the formula (V) being directly attached to the aromatic cyclic group, and at least one ortho position of the aromatic cyclic group in relation to each functional group of the formula (V) being substituted by a member selected from the group consisting of substituent atoms other than hydrogen atom and substituent groups.

DESCRIPTION OF THE PREFERRED EMBODIMENTS

The thermosensitive recording material of the present invention comprises a substrate sheet and a thermosensitive colored image-forming layer formed on a surface of the substrate sheet and comprising a substantially colorless dye precursor, a color-developing agent reactive with the dye precursor upon heating to thereby develop a color, and a binder.

In the present invention, the color-developing agent comprises at least one specific aromatic sulfonylamino(thio)carbonylamino compound having, per molecule thereof, at least two functional groups of the formula (I).

Namely, the aromatic compound having at least two functional groups of the formula (I) per molecule thereof serves as a color-developing agent for the substantially colorless dye precursor upon heating to develop a color. The aromatic compound with two or more functional groups of the formula (I) does not have a common acidic functional group such as phenolic hydroxyl group and carboxyl group. However, this aromatic compound exhibits a strong color-developing activity for the dye precursors such as leuco basic dyes. Also, this aromatic compound has a high activity for maintaining the color-developed dye at the coloring form and preventing the fading of the coloring dye.

In the advantageous properties of the aromatic compound having two or more functional groups of the formula (I), the strong color-developing activity thereof is assumed to be a result of a strong interaction of the sulfonyl(thio)urea group of the formula (I) with the dye. This strong inter action can be realized only by a functional sulfonyl(thio)urea group. This will be understood from the following fact.

Namely, organic compounds having a functional group of the formula (V):

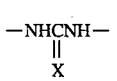

(V)

wherein X is as defined above, and which is different from the sulfonyl(thio)urea group in the lack of —$SO_2$— group; organic compounds having a functional group of the formula (VI):

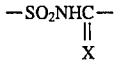

(VI)

wherein X is as defined above, and which is different from the sulfonyl(thio)urea group in the lack of —NH— group; and organic compounds having a functional group of the formula (VII):

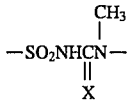

(VII)

wherein X is as defined above and which is different from the sulfonyl(thio)urea group in the substitution of the —NH— group by a

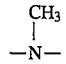

group, exhibit a significantly poorer color-developing activity for the dye precursor than that of the compound having the functional groups of the formula (I), and the resultant colored images exhibit a poor persistency which cannot stand comparison with that of the colored images formed by using the specific color-developing compound of the present invention.

The excellent persistency of the colored images formed on the thermosensitive recording material is necessarily derived from the specific color-developing aromatic compound having two or more functional groups per molecule thereof. This necessity can be established from the fact that although an aromatic compound having only one functional group of the formula (I) per molecule thereof exhibits a satisfactorily high color-developing activity, the resultant colored images exhibit a considerably poorer resistance to salad oil and a plasticizer than that of the colored images formed by using the specific color-developing aromatic compound of the present invention having two or more functional groups of the formula (I) per molecule thereof.

In an embodiment of the present invention, the aromatic compound having at least two functional groups of the formula (I) per molecule thereof is selected from those of the formula (II):

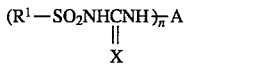

(II)

in which X represents an oxygen or sulfur atom, $R^1$ represents an aromatic group substituted with at least one substituent selected from the group consisting of nitro group, alkyl groups substituted with at least one halogen atom, for example, trifluoromethyl group, alkyloxy groups, for example, methoxy, and ethoxy groups, aryloxy groups, for example, phenoxy group, aralkyloxy groups, alkyl carbonyl groups, for example, acetyl group alkenyl and alkynyl groups, having an unsaturated bond, for example, ethynyl and allyl groups, cycloalkyl groups, for example, cyclopropyl arid cyclohexyl groups, aryl groups, for example, phenyl and tolyl groups, and aralkyl groups, for example, benzyl and phenetyl groups, A represents a multivalent group and n represents an integer of 2 or more.

In the color-developing aromatic compounds of the formula (II), the multivalent group represented by A is not limited to specific groups as long as it has a di or more valency, and is preferably selected from the group consisting of:

(a) carbonyl, thiocarbonyl and sulfonyl group;

(b) multivalent aliphatic hydrocarbon groups;

(c) multivalent, hetero-atom-containing aliphatic groups derived from aliphatic hydrocarbon compounds having at least one hetero-atom located in a backbone chain per molecule thereof;

(d) multivalent aliphatic groups derived from aliphatic hydrocarbon compounds having at least one member selected from the group consisting of carbonyl, thiocarbonyl, imide, imino, and sulfonyl groups and ester structures, located in a backbone chain per molecule thereof;

(e) multivalent aliphatic aromatic groups derived from aliphatic hydrocarbon compounds having at least one member selected from the group consisting of unsubstituted and substituted aromatic hydrocarbon groups, located in a backbone chain per molecule thereof;

(f) multivalent organic groups derived from aliphatic hydrocarbon compounds having at least one member selected from the group consisting of unsubstituted and substituted aromatic hetero-cyclic groups, located in a backbone chain per molecule thereof;

(g) multivalent aromatic groups derived from unsubstituted and substituted aromatic hydrocarbon compounds;

(h) multivalent aromatic heterocyclic groups derived from unsubstituted and substituted hetero-cyclic compounds; and (i) multivalent organic groups derived from organic compounds in which two or more aromatic or aromatic heterocyclic groups are bonded to each other through one or more multivalent groups selected from the abovementioned groups (a) to (d).

The color-developing aromatic compounds of the formula (II) are preferably selected from the group consisting of, for example, bis(p-methoxybenzenesulfonylaminocarbonylamino)ketone, 1,2-bis(p-methoxybenzenesulfonylaminocarbonylamino)ethane, 1,5-bis(p-methoxybenzenesulfonylaminocarbonylamino)-3-oxapentane, 1,3-bis(p-methoxybenzenesulfonylaminocarbonylamino)-2-propane, 1,5-bis(p-methoxybenzenesulfonylaminocarbonylamino)-3-(2-(p-methoxybenzenesulfonylaminocarbonylamino)ethyl)-3-azapentane, 1,3-bis(p-methoxybenzenesulfonylaminocarbonylaminomethyl)benzene, 4,4'-bis(p-methoxybenzenesulfonylaminocarbonylamino)diphenylmethane, 4,4'-bis(p-methoxybenzenesulfonylaminothiocarbonylamino)diphenylmethane, 4,4'-bis(p-nitrobenzenesulfonylaminocarbonylamino)diphenylmethane, 4,4'-bis(m-trifluoromethylmethoxybenzenesulfonylaminocarbonylamino)diphenylmethane, 4,4'-bis(p-phenoxybenzenesulfonylaminocarbonylamino)diphenylmethane, 4,4'-bis(p-benzyloxybenzenesulfonylaminocarbonylamino)diphenylmethane, 4,4'-bis(p-acetylbenzenesulfonylaminocarbonylamino)diphenylmethane, 4,4'-bis(p-benzoylbenzenesulfonylaminocarbonylamino)diphenylmethane, 4,4'-bis(p-allyloxybenzenesulfonylaminocarbonylamino)diphenylmethane, 4,4'-bis(p-allylbenzenesulfonylaminocarbonylamino)diphenylmethane, 4,4'-bis(p-ethynylbenzenesulfonylaminocarbonylamino)diphenylmethane, 4,4'-bis(p-cyclohexylbenzenesulfonylaminocarbonylamino)diphenylmethane, 4,4'-bis(p-phenylbenzensulfonylaminocarbonylamino)diphenylmethane, 4,4'-bis(p-benzylbenzenesulfonylaminocarbonylamino)diphenylmethane, 4,4'-bis(o-methoxybenzenesulfonylaminocarbonylamino)diphenylmethane, 4,4'-bis(p-methoxybenzenesulfonylaminothiocarbonylamino)diphenylmethane, 2,2-bis(4'-(p-methoxybenzenesulfonylaminocarbonylamino)phenyl)propane, 1,2-bis(4'-(p-methoxybenzenesulfonylaminocarbonylamino)phenyloxy)ethane, 3,3'-bis(p-methoxybenzenesulfonylaminocarbonylamino)diphenylsulfone, 4,4'-bis(p-methoxybenzenesulfonylaminocarbonylamino)diphenylether, 2,5-bis(p-methoxybenzenesulfonylaminocarbonylaminomethyl)furan, 1,3-bis(p-methoxybenzenesulfonylaminocarbonylamino)benzene, and 1,5-bis(p-methoxybenzenetoluenesulfonylaminocarbonylamino)naphthalene.

In another embodiment of the present invention, the color-developing aromatic compounds having at least two functional groups of the formula (I) per molecule thereof are selected from those of the formula (III):

$$(R^2-SO_2NH\underset{\underset{X}{\|}}{C}NH)_n-E \qquad \text{(III)}$$

in which X represents an oxygen or sulfur atom, $R^2$ represents a member selected from alkyl group, preferably having 1 to 8 carbon atoms, cycloalkyl groups, preferably having 3 to 10 carbon atoms, alkenyl groups, preferably having 2 to 8 carbon atoms, alkinyl groups, preferably having 2 to 8 carbon atoms, alkyl groups having at least one hetero atom contained in the backbone chain thereof, for example, methoxyethane and ethoxyethane groups cycloalkyl groups having at least one hetero atom contained in the cyclic chain thereof, for example, cyclohexane and decahydronaphthalene groups, and alkenyl groups having at least one hetero atom contained in the backbone chain thereof, for example, allyl and vinyl groups, E represents a multivalent group having at least one aromatic cyclic group, and n represents an integer of 2 or more.

In the aromatic compounds of the formula (III), the multivalent groups represented by E are not limited to specific types of groups as long as it has di- or more valency, and preferably selected from the group consisting of (e) multivalent aliphatic aromatic groups derived from aliphatic hydrocarbon compounds having at least one member selected from the group consisting of unsubstituted and substituted aromatic hydrocarbon groups, located in a backbone chain per molecule thereof;

(f) multivalent organic groups derived from aliphatic hydrocarbon compounds having at least one member selected from the group consisting of unsubstituted and substituted aromatic hetero-cyclic groups, located in a backbone chain per molecule thereof;

(g) multivalent aromatic groups derived from unsubstituted and substituted aromatic hydrocarbon compounds;

(h) multivalent aromatic heterocyclic groups derived from unsubstituted and substituted aromatic heterocyclic compounds; and (i) multivalent organic groups derived from organic compounds in which two or more aromatic or aromatic heterocyclic groups are bonded to each other through one or more multivalent groups selected from the above-mentioned groups (a) to (d).

The color-developing aromatic compounds of the formula (III) are preferably selected from the group consisting of:

4,4-bis(methanesulfonylaminocarbonylamino)-diphenylmethane, 4,4'-bis(ethanesulfonylaminocarbonylamino) diphenylmethane, 4,4'-bis(isopropanesulfonylaminocarbonylamino)-diphenylmethane, 4,4'-bis(trifluoromethanesulfonylaminocarbonylamino)diphenylmethane, 4,4'-bis(cyclohexanesulfonylaminocarbonylamino)diphenylmethane, 4,4'-bis(allylsulfonylaminocarbonylamino)diphenylmethane, 4,4'-bis(2-methoxyethanesulfonylaminocarbonylamino)diphenylmethane, 4,4'-bis(2-tetrahydropyransulfonylaminocarbonylamino)diphenylmethane, 4,4'-bis(2-allyloxyethanesulfonylaminocarbonylamino)diphenylmethane, 1,5-bis(methanesulfonylaminocarbonylamino)naphthalene, 1,3-bis(methanesulfonylaminocarbonylamino)benzene, 4,4'-bis(methanesulfonylaminocarbonylamino)diphenylether, and 4,4'-bis(methanesulfonylaminothiocarbonylamino)diphenylmethane.

In still another embodiment of the present invention, the color-developing aromatic compounds having at least two functional groups of the formula (I) per molecule thereof, are selected from those of the formula (IV):

$$(R^3-SO_2NH\underset{\underset{X}{\|}}{C}NH)_n A \qquad (IV)$$

in which X represents an oxygen or sulfur atom, $R^3$ represents a member selected from the group consisting of aralkyl groups, for example, benzyl and phenethyl groups; substituted aralkyl groups having a hetero atom-containing aliphatic hydrocarbon moiety in which at least one methylene group is replaced by at least one hetero atom, for example, phenoxyethyl and naphthoxyethyl groups; substituted aralkyl groups having a substituted aromatic hydrocarbon moiety in which at least one member selected from the group consisting of substituent atoms other than hydrogen atom and substituent group is attached to an aromatic hydrocarbon moiety, for example, methoxybenzyl and chlorobenzyl groups; and substituted aralkyl groups having a hetero atom-containing aliphatic hydrocarbon moiety in which at least one methylene group is replaced by at least one hetero atom, and a substituted aromatic hydrocarbon moiety in which at least one member selected from the group consisting of substituent atoms other than hydrogen atom and substituent groups is attached to the aromatic hydrocarbon moiety, for example, (p-methoxyphenoxy) ethyl and (p-chlorophenoxy) ethyl groups, A represents a multivalent group and n represents an integer of 2 or more.

The multivalent group represented by A in the formula (IV) is not limited to a specific type of group and is preferably selected from the same multivalent groups (a) to (i) as those for the formula (II).

The color-developing aromatic compounds of the formula (IV) are preferably selected from the group consisting of:

4,4'-bis(benzylsulfonylaminocarbonylamino)diphenylmethane, 4,4'-bis(p-methylbenzylsulfonylaminocarbonylamino)diphenylmethane, 4,4'-bis(p-methoxybenzylsulfonylaminocarbonylamino)diphenylmethane, 4,4'-bis(p-chlorobenzylsulfonylaminocarbonylamino)diphenylmethane, 4,4'-bis(2-phenoxyethylsulfonylaminocarbonylamino)diphenylmethane, 4,4'-bis(2-(p-methoxyphenoxy)ethylsulfonylaminocarbonylamino)diphenylmethane, 4,4'-bis(benzylsulfonylaminocarbonylamino)diphenylether, 1,5-bis(benzylsulfonylaminocarbonylamino)naphthalene, 1,3-bis(benzylsulfonylaminocarbonylamino)benzene, and 4,4'-bis(benzylsulfonylaminothiocarbonylamino)diphenylmethane.

In a further embodiment of the present invention, the color-developing aromatic compounds having at least two functional groups of the formula (I) per molecule thereof, are selected from aromatic compounds having, per molecule thereof, an aromatic cyclic group and at least two functional groups of the formula (V):

$$R^4-SO_2NH\underset{\underset{X}{\|}}{C}NH- \qquad (V)$$

wherein X is as defined above, and $R^4$ represents a member selected from the group consisting of unsubstituted aromatic groups, for example, benzene and naphthalene groups; and substituted aromatic groups having at least one substituent selected from the group consisting of alkyl groups with 1 to 4 carbon atoms, for example, methyl and ethyl groups, and halogen atoms, for example, chlorine atom, the functional groups of the formula (V) being directly attached to the aromatic cyclic group, and at least one ortho position of the aromatic cyclic group in relation to each functional group of the formula (V) being substituted by a member selected from the group consisting of substituent atoms other than hydrogen atom.

In the aromatic compounds having at least two functional groups of the formula (V), the aromatic cyclic group, to which the functional groups of the formula (V) are attached, is not limited to a specific type of group, as long as it has at least one aromatic cyclic structure.

Preferably, the aromatic cyclic group is selected from the group consisting of:

(j) multivalent aromatic cyclic groups derived from aromatic hydrocarbon compounds having at least one substituent atom or group;

(k) multivalent aromatic cyclic groups derived from hetero aromatic cyclic compounds having at least one substituent atom group; and (l) multivalent aromatic cyclic groups derived from an aromatic cyclic compound in which at least two of the multivalent aromatic cyclic groups recited in the above-mentioned (j) and (k) are bonded to each other through a bonding group selected from the group consisting of:

(i) multivalent groups derived from aliphatic hydrocarbon compounds, (ii) multivalent groups derived from aliphatic hydrocarbon compounds, of which a backbone chain contains at least one unsubstituted or substituted aromatic hydrocarbon group, (iii) multivalent groups derived from an aliphatic hydrocarbon compound of which a backbone chain contains at least one unsubstituted or substituted hetero aromatic group, (iv) multivalent groups derived from aliphatic hydrocarbon compounds of which a backbone chain contains at least one hetero atom, (v) multivalent groups derived from aliphatic hydrocarbon compounds of which a backbone chain contains at least one member selected from the group consisting of carbonyl group, thiocarbonyl group, imide group, imino group, sulfonyl group and ester structures, (vi) multivalent groups selected from the group consisting of carbonyl group, thiocarbonyl groups and sulfonyl group, and (vii) multivalent atoms selected from the group consisting of oxygen atom, sulfur atom and nitrogen atom.

In the aromatic cyclic groups (j), (k) and (l) mentioned above, the substituents are selected from substituent atoms other than hydrogen atom and substituent groups. The substituent atoms include halogen atoms, for example, fluorine and chlorine atoms. The substituent groups include alkyl groups preferably having 1 to 4 carbon atoms, for example, methyl, ethyl groups; alkenyl and alkynyl groups having an unsaturated bond, for example, ethynyl and allyl groups; cycloalkyl groups, for example, cyclopropyl and cyclohexyl groups; aryl groups, for example, phenyl and tolyl groups; aralkyl groups, for example, benzyl and phenethyl groups; alkoxyl groups, for example, methoxy and ethoxy groups; nitro group; and acetyl group.

The color-developing aromatic compounds having at least two functional groups of the formula (V) attached to the aromatic cyclic group are preferably selected from the group consisting of:

1,3-bis(p-toluenesulfonylaminocarbonylamino)-2-methylbenzene, 1,4-bis(p-toluenesulfonylaminocarbonylamino)-2,5-dimethylbenzene, 4,4'-bis(p-toluenesulfonylaminocarbonylamino)-3,3'-dimethyldiphenylmethane, 4,4'-bis(p-toluenesulfonylaminothiocarbonylamino)-3,3'-dimethyldiphenylmethane, 4,4'-bis(o-toluenesulfonylaminocarbonylamino)-3,3'-dimethyldiphenylmethane, 4,4'-bis(benzenesulfonylaminocarbonylamino)-3,3'-dimethyldiphenylmethane, 4,4'-bis(p-toluenesulfonylaminocarbonylamino)-3,3'-diethyldiphenylmethane, 4,4'-bis(p-toluenesulfonylaminocarbonylamino)-3,3'-dichlorodiphenylmethane, 4,4'-bis(p-toluenesulfonylaminocarbonylamino)-3,3',5,5'-tetramethyldiphenylmethane, 4,4'-bis(p-toluenesulfonylaminocarbonylamino)-3,3',5,5'-tetraethyldiphenylmethane, 4,4'-bis(p-toluenesulfonylaminocarbonylamino)-3,3'-dimethoxyl-biphenyl, 4,4'-bis(p-toluenesulfonylaminocarbonylamino)-3,3'-dimethyl-biphenyl, 4,4'-bis(p-toluenesulfonylaminocarbonylamino)-2,2',5,5'-tetrachlorobiphenyl, 2,8-dimethyl-3,7-bis(p-toluenesulfonylamino-carbonylamino)-dibenzothiophene-5,5-dioxide, 4,4'-bis(p-toluenesulfonylaminocarbonylamino)-3,3'-dimethyldiphenylether, and 2,5-bis(p-toluenesulfonylaminocarbonylaminomethyl)-3,5-diethylfuran.

The color-developing aromatic compounds of the present invention having at least two functional groups of the formula (I) per molecule thereof can be produced, for example, by the following reactions (1) to (3):

Reaction (1)

$$nR-SO_2-N=C=O + (H_2N)_{\overline{n}}M \longrightarrow (R-SO_2NH\underset{\underset{O}{\|}}{C}NH\underset{\underset{O}{\|}}{C}NH)_{\overline{n}}M$$

Reaction (2)

$$nR-SO_2NH_2 + (X=C=N)_{\overline{n}}M \longrightarrow (R-SO_2NH\underset{\underset{X}{\|}}{C}NH)_{\overline{n}}M$$

Reaction (3)

$$nR-SO_2NH\underset{\underset{X}{\|}}{C}OR^5 + (H_2N)_{\overline{n}}M \xrightarrow{Base} (R-SO_2NH\underset{\underset{X}{\|}}{C}NH)_{\overline{n}}M + nR^5OH$$

In the above-mentioned reactions (1), (2) and (3), R represents the monovalent organic group as defined for $R^1$ of the formula (II), $R^2$ of the formula (III), $R^3$ of the formula (IV) and $R^4$ of the formula (V), X is as defined above, M represents the multivalent group as defined for A of the formula (II) and (IV), E of the formula (III) and the aromatic cyclic group to which the functional groups of the formula (V) are attached, $R^5$ represents a member selected from the group consisting of lower alkyl groups and aryl groups, and n is as defined above.

In the thermosensitive colored image-forming layer of the present invention, the content of the color-developing aromatic compound having at least two functional groups of the formula (I) is preferably in the range of from 10 to 50% based on the total dry weight of the thermosensitive colored image-forming layer. When the content is less than 10% by weight, the resultant thermosensitive colored image-forming layer exhibits an unsatisfactorily poor color-developing activity. Also, even if the content of the color-developing aromatic compound is raised to a level above 50% by weight, the color-developing activity of the resultant thermosensitive colored image-forming layer is saturated and no further improvement in the color-developing activity is obtained and it causes an economical disadvantage.

In the thermosensitive colored image-forming layer of the present invention, the color-developing agent comprises one or two or more of the above-mentioned specific aromatic compounds.

The dye precursor usable for the present invention comprises at least one member elected from conventional triphenylmethane, fluoran, and diphenylmethane leuco dyes, for example, 3-(4-diethylamino-2-ethoxyphenyl)-3-(1-ethyl-2-methylindole-3-yl)-4-azaphthalide, crstyal violet lactone, 3-(N-ethyl-N-isopentylamino)-6-methyl-7-anilinofluoran, 3-diethylamino-6-methyl-7-anilinofluoran, 3-diethylamino-6-methyl-7-(o,p-dimethylphenylamino)fluoran, 3-(N-ethyl-N-p-toluidino)-6-methyl-7-anilinofluoran, 3-pyrrolidino-6-methyl-7-anilinofluoran, 3-dibutylamino-6-methyl-7-anilinofluoran, 3-(N-cyclohexyl-N-methylamino)-6-methyl-7-anilinofluoran, 3-diethylamino-7-(o-chloranilino)fluoran, 3-diethylamino-7-(m-trifluoromethylanilino)fluoran, 3-diethylamino-6-methyl-7-chlorofluorane, 3-diethylamino-6-methylfluoran, 3-cyclohexylamino-6-chlorofluoran, 3-(N-ethyl-N-hexylamino)-6-methyl-7-(p-chloroanilino)fluoran, 2-chloro-3-methyl-6-(N,N-dibutylamino-anilino)fluoran, 3-(p-anilinoanilino)-6-methyl-7-anilinofluoran, 3,6-bis(dimethylamino)fluoran-9-spiro-3'-(6'-dimenthylaminophthalide, 3,3-bis(2-(p-dimethylaminophenyl)-2-(p-methoxyphenyl)ethenyl)-4,5,6,7-tetrachlorophthalide, and bis(p-dimethylaminostyryl)-p-toluenesulfonylmethane.

In the thermosensitive colored image-forming layer of the present invention, the color-developing agent optionally contains at least one other or a conventional color-developing compound in addition to the aromatic compounds having two or more functional groups of the formula (I), unless the color-forming performance of the colored image-forming layer is disturbed thereby.

The other color-developing compound is preferably selected from the N-aryl sulfonylurea compounds of the formula (VI):

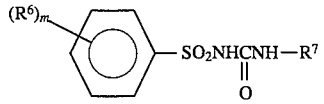

(VI)

wherein $R^6$ represents a member selected from the group consisting of hydrogen and halogen atoms, and lower alkyl groups preferably having 1 to 4 carbon atoms, aryl groups, for example, phenyl and tolyl group, alkoxyl groups preferably having 1 to 4 carbon atoms, acetyl group and nitro group, $R^7$ represents a member selected from the group consisting of unsubstituted phenyl and naphthyl groups and substituted phenyl and naphthyl groups having at least one substituent selected from the group consisting of alkoxyl, acetyl, nitro and lower alkyl groups and halogen atoms, m represents an integer of 1 to 5, the substituents represented by $R^6$ may be the same as or different from each other.

The color-developing N-aryl sulfonylurea compounds of the formula (VI) are preferably selected from the group consisting of:

N-(p-toluenesulfonyl)-N'-phenylurea,
N-(p-toluenesulfonyl)-N'-(p-methoxyphenyl)urea,
N-(p-toluenesulfonyl)-N'(o-tolyl)urea,
N-(p-toluenesulfonyl)-N'-(m-tolyl)urea,
N-(p-toluenesulfonyl)-N'-(p-tolyl)urea,
N-(p-toluenesulfonyl)-N'-(o-chlorophenyl)urea,
N-(p-toluenesulfonyl)-N'-benzylurea,
N-(p-toluenesulfonyl)-N'-(1-naphthyl)urea
N-(benzenesulfonyl)-N'-phenylurea,
N-(o-toluenesulfonyl)-N'-phenylurea,
N-(p-toluenesulfonyl)-N'-(o-diphenyl)urea,
N-(p-toluenesulfonyl)-N'-(p-ethoxycarbonylphenyl)urea,
N-(p-methoxybenzenesulfonyl)-N'-phenylurea,
N-(3-nitrobenzenesulfonyl)-N'-phenylurea,
N-(3-nitro-4-methoxybenzenesulfonyl)-N'-phenylurea,
N-(benzenesulfonyl)-N'-(p-methoxyphenyl)urea,
N-(toluenesulfonyl)-N'-(4-nitro-1-naphthyl)urea,
N-(benzenesulfonyl)-N'-p-acetylphenylurea,
N-(p-acetylbenzenesulfonyl)-N'-(m-tolyl)urea, and
N-(p-methoxybenzenesulfonyl)-N'-benzylurea.

The conventional color-developing compounds usable for the present invention are preferably selected from the group consisting of 2,2-bis(4-hydroxyphenyl)propane (namely bisphenol A), 1,1-bis(4-hydroxyphenyl)-1-phenylethane, 1,4-bis(1-methyl-1-(4'-hydroxyphenyl)ethyl)benzene, 1,3-bis(1-methyl-1-(4'-hydroxyphenyl)ethyl)benzene, dihydroxydiphenylether (disclosed in JP-A-1-180,382), benzyl p-hydroxybenzoate (disclosed in JP-A-52-140,483), bisphenol S, 4-hydroxy-4'-isopropyloxy-diphenylsulfone (disclosed in JP-A-60-13,852), 1,1-di(4-hydroxyphenyl)-cyclohexane, 1,7-di(4-hydroxyphenylthio)-3,5-dioxaheptane (disclosed in JP-A-59-52,694), and 3,3'-diallyl-4,4'-dihydroxydiphenylsulfone (disclosed in JP-A-60-208,286).

The above-mentioned other or conventional color-developing compounds can be employed alone or as a mixture of two or more thereof.

When the other or conventional color-developing compound is employed, its content in the colored image-forming layer is preferably 5 to 40% by weight.

The binder serves to bond the components in the colored image-forming layer to the substrate sheet and preferably comprises at least one member selected from water-soluble polymeric materials, for example, polyvinyl alcohols of various molecular weight, starch and starch derivatives, cellulose derivatives, for example, methoxy cellulose, carboxymethyl cellulose, methyl cellulose and ethyl cellulose, sodium polyacrylate, polyvinyl pyrrolidine, acrylic acid amide-acrylic acid ester copolymers, acrylic acid amide-acrylic acid ester-methacrylic acid terpolymers, alkali salts of styrenemaleic anhydride copolymers, polyacrylic acid amide, sodium alginate, gelatine and casein, and water-insoluble polymeric materials, for example, polyvinyl acetate resins, polyurethane resins, styrene-butadiene copolymer resins, polyacrylic acid resins, polyacrylic acid ester resins, vinyl chloride-vinyl acetate copolymer resins, polybutyl acrylate, ethylene-vinyl acetate copolymer resins and styrene-butadiene-acrylic compound-terpolymer resins, used in the form of a latex.

In the thermosensitive colored image-forming layer of the present invention, the dye precursor is present in an amount of 5 to 20% of weight together with 5 to 50% of the color-developing compound of the formula (I) and the binder is present in an amount of 5 to 20% by weight, based on the total dry weight of the colored image-forming layer.

The thermosensitive colored image-forming layer of the present invention optionally further comprises a heat-fusible organic substance, usually referred to as a sensitizer, non-basic inorganic and organic pigments, antioxidants, for example, hindered phenol compounds, ultraviolet ray-absorbers, and waxes.

The sensitizing agent comprises at least one organic compound having a melting point of from 50° C. to 150° C., for example, phenyl 1-hydroxy-2-naphthoate (disclosed in JP-A-57-191,089), p-benzylbiphenyl (JP-A-60-82,382), benzylnaphthylether (JP-A-58-87,094), dibenzyl terephthalete (JP-A-58-98,285), benzyl p-benzyloxybenzoate (JP-A-57-201,691), diphenyl carbonate, ditolyl carbonate (JP-A-58-136,489), m-terphenyl (JP-A-57-89,994), 1,2-bis(m-tolyloxy)ethane (JP-A-60-56,588), 1,5-bis(p-methoxyphenoxy)-3-oxapentane (JP-A-62-181,183), oxalic acid diesters (JP-A-64-1,583) 1,4-bis(p-tolyloxy)benzene (JP-A-2-153,783), diphenyl sulfone (melting point: 124° C.), phenyl p-toluene-sulfonate (m.p.: 96° C.), p-tolyl mesitylenesulfonate (m.p.: 100° to 102° C.), 4,4'-diallyloxydiphenylsulfone (m.p.: 145° C.), 4,4'-diisopentyloxydiphenylsulfone (m.p.: 100° C.), 4,4'-dimethoxydiphenylsulfone (m.p.: 130° C.), bis(4-(2-(($C_{14}$, $C_{16}$ or $C_{18}$)alkanoyl(or alkenoyl)oxy)ethoxy)phenyl)sulfone, 2,2-bis (4-benzenesulfonyloxyphenyl)propane (m.p.: 114° C.), 2,2-bis(4-methanesulfonyloxyphyenyl)propane (m.p.: 101° C.), p-toluenesulfonanilide (m.p.: 102° C.) and N-benzyl-o-sulfophthalimide.

The thermosensitive colored image-forming layer optionally contains an antioxidant, for example, hindered phenolic compound and/or ultraviolet ray-absorbers.

The antioxidant and ultraviolet ray-absorbers are preferably selected from those disclosed in JP-A-57-151,394, JP-A-58-160,191, JP-A-58-69,096, JP-A-59-2,884, JP-A-59-95,190, JP-A-60-22,288, JP-A-60-255,485, JP-A-61-44,686, JP-A-62-169,683, JP-A-63-17,081, JP-A-1-249,385, and JP-A-4-144,786 for example, 1,1,3-tris(2'-methyl-3'-cyclohexyl-4'-hydroxyphenyl)butane; 1,1,3-tris(2-methyl-4-hydroxy-5-tert-butylphenyl)butane, 4,4'-thio-bis(3-methyl-6-tert-butylphenol), 1,3,5-trimethyl-2,4,6-tris(3,5-di-tert-butyl-4-hydroxybenzyl)benzene, 2,2'-dihydroxy-4,4'-dimethoxybenzophene, p-octylphenyl salicylate, 2-(2'-hydroxy-5'-methylphenyl)benzotriazole, ethyl-2-cyano-3,3'-diphenyl acrylate, and tetra(2,2,6,6-tetramethyl-4-piperidyl)-1,2,3,4-butane-tetracarbonate.

The inorganic and organic pigments usable for the present invention are preferably selected from inorganic fine particles of, for example, calcium carbonate silica, zinc oxide, titanium dioxide, aluminum hydroxide, zinc hydroxide, barium sulfate, clay, anhydrous clay, talc, surface-modified calcium carbonate, and silica and organic fine particles of, for example, urea-formaldehyde resins, styrene-methacrylate copolymer resins and polystyrene resins.

The waxes usable for the present invention preferably comprise at least one member selected from, for example, paraffin waxes, carnauba wax, microcrystalline waxes, polyethylene waxes, amide type waxes, bisimide type waxes, higher fatty acid amide waxes, for example, stearic acid amide, ethylene-bis-stearoamide wax, higher fatty acid esters and metal salts, for example, zinc stearate, aluminum stearate, calcium stearate, and zinc oleate.

In the colored image-forming layer of the present invention, the sensitizing agent is preferably contained in an amount of 10 to 40% by weight, the wax and organic or inorganic pigment are optionally contained in amounts of 2 to 20% by weight and 2 to 50% by weight, respectively, and the antioxidant and ultraviolet ray-absorber are optionally contained in an amount of 1 to 10%, based on the total dry weight of the colored image-forming layer.

The sheet substrate usable for the present invention is not limited to a specific group of materials, and usually the sheet substrate comprises a member selected from fine paper sheets, coated paper sheets having a clay or latex-coated layer, cast-coated paper sheets, paper boards, plastic resin films, synthetic paper sheets comprising a plastic resin such as a polyolefin resin and a multi-layer structure, and laminated composite sheets. Preferably, the sheet substrate has a basis weight of 40 to 170 g/m$^2$.

The colored image-forming layer can be formed on a surface of sheet substrate, by applying a coating liquid containing the above-mentioned components, and by drying and solidifying the coating liquid layer on the sheet substrate.

The colored image-forming layer is preferably present in a dry weight of from 1 to 15 g/m$^2$, more preferably 2 to 10 g/m$^2$.

In the present thermosensitive recording material, a protective layer and/or a layer for printing may be formed on the colored image-forming layer.

The thermosensitive recording material of the present invention is provided with a specific thermosensitive colored image-forming layer characterized by containing a specific color-developing agent. This specific color-developing agent comprises at least one aromatic compound having at least two functional sulfonylamino(thio)carbonylamino groups of the formula (I), and causes not only the resultant thermosensitive colored image-forming layer to exhibit a high whiteness and a satisfactory thermosensitivity, but also the resultant colored images on the colored image-forming layer exhibit an excellent resistance to oily and fatty substances and a plasticizer even immediately after the color development, and thus have a superior storage persistency.

EXAMPLES

The present invention will be further explained by the following specific examples, which are merely representative and do not in any way restrict the scope of the present invention.

Synthesis Example 1 (Preparation of 4,4'-bis(p-methoxybenzenesulfonylaminocarbonylamino)-diphenylmethane)

(1) Synthesis of p-methoxysulfonamide p-Methoxybenzenesulfonylchloride having a molecular weight of 206.5 was dissolved in an amount of 0.1 mole in 200 ml of a concentrated aqueous ammonia solution, and the resultant solution was agitated at room temperature for 3 hours. Then, the solution was neutralized by using a diluted aqueous hydrochloric acid, and a reaction product was extracted with ether. The resultant ether phase was washed with water and dried in the presence of a drying agent consisting of anhydrous magnesium carbonate for one night. The reaction product mixture was filtered, and the solvent was evaporated away from the resultant product. A white solid product was obtained.

The product was subjected to a mass spectrometric analysis. As a result, a molecular ion peak (m/l=187) was confirmed and it was identified that the resultant product was the aimed compound.

(2) Synthesis of 4,4'-bis(p-methoxybenzene-sulfonylaminocarbonylamino) diphenylmethane p-Methoxysulfonamide prepared by the above-mentioned method in an amount of 13.2 g (0.07 mole) was mixed in the form of a fine powder with 8.0 g (0.032 mole) of 4,4'-diphenylmethanediisocyanate, and the mixed powder was heated at a temperature of 140° C. within a nitrogen gas stream. The mixture was dissolved and liquefied with the lapse of the heating time, and thereafter was solidified as a result of the reaction. After the heating for one hour, the heating procedure was stopped, the resultant mixture was cooled, and the resultant reaction product was extracted by an 1N aqueous sodium hydroxide solution. The extract solution was neutralized so as to cause the reaction product to be precipitated, and the precipitated solid product was filtered and dried. By repeating the above-mentioned procedures, a white solid product was obtained in an amount of 14.1 g. In the temperature range of up to 220° C., the white solid product did not exhibit a certain melting point.

The white solid product was subjected to a high speed liquid chromatographic analysis. It was confirmed that the white solid product has a different peak than that of p-methoxysulfonamide and 4,4'-diphenylmethane diisocyanate. Also, NMR spectral analysis and IR spectral analysis identified the resultant white solid product as the aimed compound.

NMR Spectral Analyss (in deuterated DMSO)

δ=3.85 (s, 8H, hydrogen in methoxy and hydrogen in methylene overlapped each other)

δ=7.13–7.85 (m, 18H, hydrogen in aromatic cyclic structures and in NH).

In addition, a peak appeared at δ=about 9.2 which was assumably derived from the —NH group adjacent to sulfonyl group.

IR Spectral Analysis (KBr tablet method)

In this analysis, the following characteristic absorptions were confirmed.

1740 $cm^{-1}$ (derived from carbonyl group in urea group)

1345 $cm^{-1}$, 1160 $cm^{-1}$ (derived from sulfonyl group).

Synthesis Example 2 (Preparation of 4,4'-bis(m-nitrobenzenesulfonylaminocarbonylamino)diphenylmethane (1) Synthesis of m-nitrobenzenesulfonamide The same synthesis procedures as in Synthesis Example 1-(1) were carried out with the following exceptions.

22.2 g of m-nitrobenzenesulfonylchloride having a molecular weight of 221.5 were used in an amount of 0.10 mole in place of 20.7 g of p-methoxybenzenesulfonylchloride.

The resultant light yellow solid product was subjected to the mass spectrometer analysis. As a result, a molecular ion peak (m/l=202) was confirmed and it was identified that the resultant solid product was the aimed compound.

(2) Synthesis of 4,4'bis(m-nitrobenzenesulfonylaminocarbonylamino! dipheyl methane The same procedures as in Synthesis Example 1-(2) were carried out with the following exceptions.

In the synthesis reaction, 13.2 g of p-methoxy sulfonamide were replaced by 14.2 g of m-nitrobenzenesulfonamide. A slightly yellowish solid product was obtained in an amount of 15.0 g. This slightly yellowish solid product did not exhibit a clear melting point in a temperature range of up to 220° C.

The high speed liquid chromatography confirmed that the reaction product exhibited a peak different from m-nitrobenzenesulfonamide and 4,4'-diphenylmethanediisocyanate.

Also, NMR spectral analysis and IR spectral analysis identified the resultant slightly yellowish solid product as the aimed compound.

NMR Spectral Analysis (in deuterated DMSO)

δ=3.89 (s, 2H), 7.07–9.10 (m, 18H hydrogen in aromatic cyclic structure and in NH).

Also, a peak was appeared at δ=about 10.5 which was assumably derived from the NH group located adjacent to the sulfonyl group.

IR Spectral Analysis (KBr tablet method)

1740 $cm^{-1}$ (derived from carbonyl group in urea group)

1355 $cm^{-1}$, 1155 $cm^{-1}$ (derived from sulfonyl group)

Synthesis Example 3 (Preparation of 4,4'-bis-(methanesulfonylaminocarbonylamino)diphenylmethane The same procedures as in Synthesis Example 1 were carried out with the following exceptions.

In step (2), 13.2 g of p-methoxysulfonamide were replaced by 6.4 g of methanesulfonamide. A slightly yellowish solid product was obtained in an amount of 14.0 g.

The high speed liquid chromatography confirmed that the above-mentioned reaction product exhibited a peak different from that in the material compounds, and the NMR spectral analysis and the IR spectral analysis identified the resultant slightly yellowish solid product as the aimed compound.

NMR Spectral Analysis (in deuterated DMSO)

δ=3.30 (s, 6H), 3,85(s, 2H), 7.25(dd, 8H)

Also, a peak which was assumably derived from NH group adjacent to sulfonyl group appeared at δ=about 9.0 and about 10.0

IR Spectral Analysis (KBr tablet method)

The following characteristic absorptions were confirmed.

1690 $cm^{-1}$ (derived from carbonyl group in urea group)

1320 $cm^{-1}$, 1140 $cm^{-1}$ (derived from sulfonyl group).

Synthesis Example 4 (Preparation of 4,4'-bis(benzylsulfonylaminocarbonylamino) diphenylmethane)

(1) Synthesis of Benzylsulfonamide

The same synthesis procedures as in Synthesis Example 1-(1) were carried out with the following exceptions.

In this synthesis procedure, 20.7 g of p-methoxybenzenesulfonylchloride were replaced by 19.5 g (0.10 mole) of benzylsulfonylchloride having a molecular weight of 190.5.

The resultant white solid product was subjected to mass spectrometric analysis. As a result, a molecular ion peak (m/l=171) was confirmed and the resultant white solid product was identified as the aimed compound.

(2) Synthesis of 4,4'-bis(benzylsulfonylaminocarbonylamino)diphenylmethane

The same procedures as in Synthesis Example 1-(2) were carried out with the following exceptions.

In the synthesis procedures, 13.2 g of p-methoxysulfonamide were replaced by 11.3 g of benzylsulfonamide. A slightly yellowish solid product was obtained in an amount of 16.4 g.

The high speed liquid chromatography confirmed a peak different from that of the material compounds. Also, the NMR spectral analysis and the IR spectral analysis identified the slightly yellowish solid product as the aimed compound.

NMR Spectral Analysis (in deuterated DMSO)

δ=3.87 (s, 2H), 4,77 (s, 4H), 7,17–7.39 (m, 18H)

Also, a peak, which was assumably derived from NH group next to sulfonyl group, appeared at δ=about 8.7 and about 10.0.

IR Spectral Analysis (KBr Tablet Analysis)

1700 $cm^{-1}$ (derived from carbonyl in urea group)

1340 $cm^{-1}$, 1150 $cm^{-1}$ (derived from sulfonyl).

Example 1

A thermosensitive recording paper sheet was prepared by the following procedures.

(1) Preparation of an Aqueous Dye Precursor Dispersion A

A mixture was prepared in the following composition.

| Component | Part by weight |
|---|---|
| 3-(N,N-dibutylamino)-6-methyl-7-anilinofluoran | 20 |
| 10% aqueous solution of polyvinyl alcohol | 10 |
| Water | 70 |

The mixture was dispersed by using a paint shaker to an extent such that the resultant dispersed solid particles had an average size of 1 μm or less.

(2) Preparation of an Aqueous Color-Developing Agent Dispersion B

| Component | Part by weight |
|---|---|
| 4,4'-bis(p-methoxybenzene-sulfonylaminocarbonylamino) diphenylmethane | 10 |
| Diphenylsulfone | 10 |
| 10% aqueous solution of polyvinyl alcohol | 10 |
| Water | 70 |

The mixture was dispersed by using a paint shaker to such an extent that the resultant dispersed solid particles had an average size of 1 μm or less.

(3) Preparation of a Pigment-Coated Paper Sheet

A coating liquid was prepared by mixing an aqueous dispersion, prepared by dispersing 85 parts by weight of anhydrous clay available under the trademark of Ansilex, from Engelhard Corporation, in 320 parts by weight of water, with 40 parts by weight of an aqueous emulsion of a styrene-butadiene copolymer in a solid concentration of 50% by weight and 50 parts by weight of a 10% aqueous oxidized starch solution.

The coating liquid was coated on a surface of a fine paper sheet having a basis weight of 48 g/m$^2$, to form a coating layer having a dry weight of 7.0 g/m$^2$, whereby a coated paper sheet was obtained.

(4) Formation of Thermosensitive Colored Image-Forming Layer

A coating liquid was prepared by evenly mixing 50 parts by weight of the aqueous dye precursor dispersion A and 200 parts by weight of the aqueous color-developing agent dispersion B with 30 parts by weight of a calcium carbonate pigment, 20 parts by weight of a 25% aqueous zinc stearate dispersion, 15 parts by weight of 30% aqueous paraffin dispersion, and 100 parts by weight of a 10% aqueous polyvinyl alcohol solution, by agitating the mixture.

A surface of the pigment coated paper sheet was coated with the resultant coating liquid and dried. A thermosensitive colored image-forming layer was formed in a weight of 5.0 g/m$^2$, to provide a thermosensitive recording paper sheet.

(5) Super Calender Treatment

The recording sheet was treated by a super calender, and the calendered surface of the recording sheet had a Bekk smoothness of 900 to 1200 seconds.

(6) Whiteness Measurement and Color-Forming Test

The whiteness of he non-image-formed white portions of the recording sheet was measured by using a Hunter whiteness tester with a blue filter.

Also, the specimen of the resultant thermosensitive recording sheet was subjected to a colored image-developing test by using a dynamic color-developing tester provided by modifying a thermosensitive facsimile printer with an applied energy of 0.49 mj/dot. The resultant colored images were subjected to a measurement of a color density by a Macbeth Reflection Color Density Tester RD-914, (trademarks).

The measured color density of the colored images on the specimen is referred to as an original color density ($D_0$) of the colored images.

The values of the measured whiteness and original color density are shown in Table 1.

(7) Oil and Plasticizer Resistance Test

Specimens of the colored image-formed recording paper sheet were subjected to an oil or plasticizer resistance test in which salad oil or dioctyl terephthalate (a typical plasticizer) was applied to the colored image-formed surface of the specimen within 30 minutes from the completion of the color-developing operation. The salad oil or plasticizer-applied specimen was left to stand at room temperature for 3 hours. The salad oil or plasticizer was wiped away from the specimen, and the color density of the black colored images retained on the specimen was measured by the Macbeth Reflection Color Density Tester. The measured color density is referred to as a color density ($D_1$) after oil or plasticizer resistance test.

The resistance of the colored images to the salad oil or plasticizer is represented by a color density retention calculated from the following equation.

$$\text{Color density retention (\%)} = [(\text{color density } (D_1) \text{ afteroil or plasticizer resistance test})/(\text{original color density } (D_0))] \times 100$$

The test results are shown in Table 1.

Example 2

A thermosensitive recording sheet was produced by the same procedures as in Example 1 except that in the preparation of the dispersion B, 4,4'-bis(p-methoxybenzenesulfonylaminocarbonylamino)diphenylmethane was replaced by 4,4'-bis(benzylsulfonylamino carbonylamino)diphenylmethane.

The test results are shown in Table 1.

Example 3

A thermosensitive recording sheet was produced by the same procedures as in Example 1 except that in the preparation of the dispersion B, 4,4'-bis(p-methoxybenzeneslfonylaminocarbonylamino)diphenylmethane was replaced by 4,4'-bis(methanesulfonylaminocarbonylamino)diphenylmethane.

The test results are shown in Table 1.

Example 4

A thermosensitive recording sheet was produced by the same procedures as in Example 1 except that in the formation of the thermosensitive colored image-forming layer, a coating liquid was prepared by mixing 40 parts by weight of the dispersion A and 60 parts by weight of the dispersion B with 40 parts by weight of calcium carbonate pigment, 20 parts by weight of a 25% aqueous zinc stearate dispersion, 15 parts by weight of a 30% aqueous paraffin dispersion, 120 parts by weight of a 10% aqueous polyvinyl alcohol and 3 parts by weight of a melting agent (trademark: Dapro U 99, made by Sannopuco), while stirring the mixture.

The coating liquid was coated on a surface of a synthetic paper sheet (trademark: YUPO FPG 110, made by OJI Yukagoseishi K. K.), to form a thermosensitive colored image-forming layer having a dry weight of 8.5 g/m$^2$. A thermosensitive recording paper sheet was obtained.

The test results are shown in Table 1.

Example 5

A thermosensitive recording sheet was produced by the same procedures as in Example 1 except that in the preparation of the dispersion A, 3-(N,N-dibutylamino)-6-methyl-7-anilinofluoran was replaced by 3-(N-isopentyl-N-ethylamino)-6-methyl-7-anilinofluoran.

The test results are shown in Table 1.

Comparative Example 1

A thermosensitive recording sheet was produced by the same procedures as in Example 1 except that in the preparation of the dispersion B, 4,4'-bis(p-methoxybenzenesulfonylaminocarbonylamino)diphenylmethane was replaced by 2,2-bis(4-hydroxyphenyl)propane, namely Bisphenol A.

The test results are shown in Table 1.

Comparative Example 2

A thermosensitive recording sheet was produced by the same procedures as in Example 1 except that in the preparation of the dispersion B, 4,4'-bis(p-methoxybenzenesulfonylaminocarbonylamino)diphenylmethane was replaced by 4,4'-bis(benzenaminothiocarbonylamino)benzene.

The test results are shown in Table 1.

Comparative Example 3

A thermosensitive recording sheet was produced by the same procedures as in Example 1 except that in the preparation of the dispersion B, 4,4'-bis(p-methoxybenzenesulfonylaminocarbonylamino)diphenylmethane was replaced by N-(p-nitrobenzoyl)-p-toluenesulfonamide (having a melting point of 206° C. and disclosed in JP-A-62-19,485.

The test results are shown in Table 1.

Comparative Example 4

A thermosensitive recording sheet was produced by the same procedures as in Example 1 except that in the preparation of the dispersion 4, 4,4'-bis(p-methoxybenzenesulfonylaminocarbonylamino)diphenylmethane was replaced by N-(o-carboxybenzoyl)-p-toluenesulfonamide having a melting point of 161° C. and disclosed in JP-A-62-19,485.

TABLE 1

| Example No. | Item | Original color density ($D_0$) | Color density retention (%) Salad oil resistance | Color density retention (%) Plasticizer resistance |
|---|---|---|---|---|
| Example | 1 | 1.32 | 91 | 82 |
| | 2 | 1.34 | 94 | 80 |
| | 3 | 1.26 | 89 | 77 |
| | 4 | 1.35 | 94 | 84 |
| | 5 | 1.35 | 94 | 85 |
| Comparative Example | 1 | 1.42 | 22 | 12 |
| | 2 | 0.90 | 32 | 20 |
| | 3 | 0.79 | 21 | 17 |
| | 4 | 0.41 | 35 | 22 |

Table 1 clearly indicates that the colored images formed by using the specific color-developing agent of the present invention exhibited a significantly higher oil and plasticizer resistance than those when a typical conventional color-developing agent, namely bisphenol A in Comparative Example 1 was used. Also, in each of Examples 1 to 5, the resultant colored images exhibited a significantly higher color density ($D_0$) and oil and plasticizer resistance than those when a color-developing compound having a sulfonyl group was used in Comparative Example 2, and when a color-developing compound in which one —NH group disappeared from a —$SO_2NHC(X)NH$— group was employed in Comparative Examples 3 and 4.

Synthesis Examples 5 (Preparation of 4,4'-bis(p-toluenesulfonylaminocarbonylamino)-3,3'-dimethyldiphenylmethane)

A three-necked flask equipped with a dropping funnel and a thermometer was charged with 11.3 g of 4,4'-diamino-3,3'-dimethyldiphenylmethane and then this reactant was dispersed in 200 ml of acetonitrile. While the dispersion was vigorously agitated by a magnetic stirrer, 20.7 g of toluenesulfonylisocyanate in the dropping funnel was added at once to the dispersion. Simultaneously with the addition, an exothermic reaction occurred and a white solid product was precipitated. The resultant mixture liquid was heated at a temperature of 80° C. and agitated for one hour. Then the mixture liquid was cooled to room temperature.

The resultant reaction mixture was filtered. A white crystalline product was obtained in an amount of 30.1 g. This product had a melting point of 193° C. to 195° C.

By an NMR measurement and an IR measurement, the resultant product was identified as the aimed compound as follows.

NMR Measurement (In Deuterated DMSO).

δ=2.16 (s, 6H), 2.43 (s, 6H), 3.81 (s, 2H), 6.95 to 8.00 (m, 16H) (hydrogen in aromatic ring and in HN)

Also, a peak which was assumably derived from the —NH group adjacent to sulfonyl group, appeared at δ=about 9.8.

IR Measurement (KBr Tablet Method)

The following characteristic absorptions were confirmed.

1668 $cm^{-1}$ (derived from carbonyl group in urea group)

1345 $cm^{-1}$, 1160 $cm^{-1}$ (derived from sulfonyl group)

Synthesis Example 6 (Preparation of 4,4'-bis(p-toluenesulfonylaminocarbonylamino)-3,3'-diethyldiphenylmethane)

The above-mentioned compound was prepared by the same procedures as in Synthesis Example 5 with the following exceptions.

4,4'-diamino-3,3'-dimethyldiphenylmethane in an amount of 11.3 g was replaced by 12.7 g of 4,4'-diamino-3,3'-diethyldiphenylmethane. A slightly yellowish solid product in an amount of 32.0 g was obtained and exhibited a melting point of 199° C. to 202° C.

By the NMR measurement and IR measurement, the resultant product was identified as the aimed compound.

NMR measurement (In Deuterated DMSO)

δ=1.01 (t, 6H), 2.38 (m, 10H), 3.79 (s, 2H), 7.01 to 7.97 (m, 16H) (hydrogen in aromatic ring and in NH)

Also, a peak, which was assumably derived from the —NH— group adjacent to the sulfonyl group, appeared at δ=about 10.6.

IR measurement (KBr tablet method)

The characteristic absorptions were confirmed at the following frequencies.

1670 $cm^{-1}$ (derived from carbonyl groups in urea group)

1345 $cm^{-1}$, 1160 $cm^{-1}$ (derived from carbonyl group)

Synthesis Example 7 (Preparation of 4,4'-bis(p-toluenesulfonylaminocarbonylamino)-2,2',5,5'-tetrachlorobiphenyl)

The above-mentioned compound was prepared by the same procedures as in Synthesis Example 5 with the following exceptions.

4,4'-diamino-3,3'-dimethyldiphenylmethane in an amount of 11.3 g was replaced by 16.1 g of 4,4'-diamino-2,2',5,5'-tetrachlorobiphenyl. A white crystalline product in an amount of 33.2 g was obtained and exhibited a melting point of 237° C.

By the NMR measurement and IR measurement, the resultant product was identified as the aimed compound.

Synthesis Example 8 (Preparation of 4,4'-bis(p-toluenesulfonylaminocarbonylamino)-3,3'-dichlorodiphenylmethane)

The above-mentioned compound was prepared by the same procedures as in Synthesis Example 5 with the following exceptions.

4,4'-diamino-3,3'-dimethyldiphenylmethane in an amount of 11.3 g was replaced by 13.4 g of 4,4'-diamino-3,3'-dichlorodiphenylmethane. A white crystalline product in an amount of 31.0 g was obtained. By the NMR measurement, the resultant product was identified as the aimed compound.

NMR Measurement (In Deuterated DMSO)

δ=2.39 (s, 6H), 3.83 (s, 2H), 7.05 to 8.39 (m, 14H)

Also, a peak, which was assumably derived from the —NH— group, appeared at δ=about 11.0.

Synthesis Example 9 (Preparation of 4,4'-bis(p-toluenesulfonylaminocarbonylamino)-3,3',5 5'-tetramethyldiphenylmethane)

The above-mentioned compound was prepared by the same procedures as in Synthesis Example 5 with the following exceptions.

4,4'-diamino-3,3'-dimethyldiphenylmethane in an amount of 11.3 g was replaced by 12.7 g of 4,4'-diamino-3,3',5 5'-tetramethyldiphenylmethane. A white crystalline product in an amount of 29.5 g was obtained.

By the NMR measurement, the resultant product was identified as the aimed compound.

NMR Measurement (In Deuterated DMSO)

δ=1.94 (s, 12H), 2.39 (s, 6H), 3.70 (s, 2H), 6.86 to 7.91 (m, 12H)

Also, a peak, which was assumably derived from the —NH— group, appeared at δ=about 10.5.

Example 6

A thermosensitive recording paper sheet was prepared by the following procedures.

(1) Preparation of An Aqueous Dye Precursor Dispersion A

A mixture was prepared in the following composition.

| Component | Part by weight |
|---|---|
| 3-(N,N-isopentyl-N-ethylamino)-6-methyl-7-anilinofluoran | 20 |
| 10% aqueous solution of polyvinyl alcohol | 10 |
| Water | 70 |

The mixture was dispersed by using a paint shaker to an extent such that the resultant dispersed solid particles had an average size of 1 μm or less.

(2) Preparation of An Aqueous Color-Developing Agent Dispersion B

| Component | Part by weight |
|---|---|
| 4,4'-bis(p-methoxybenzene-sulfonylaminocarbonylamino)-3,3-dimethyldiphenylmethane | 10 |
| Diphenylsulfone | 10 |
| 10% aqueous solution of polyvinyl alcohol | 10 |
| Water | 70 |

The mixture was dispersed by using a paint shaker to such an extent that the resultant dispersed solid particles had an average size of 1 μm or less.

(3) Preparation of a Pigment-Coated Paper Sheet

A coating liquid was prepared by mixing an aqueous dispersion, prepared by dispersing 85 parts by weight of anhydrous clay available under the trademark of Ansilex, from Engelhard Corporation, in 320 parts by weight of water, with 40 parts by weight of an aqueous emulsion of a styrene-butadiene copolymer in a solid concentration of 50% by weight and 50 parts by weight of a 10% aqueous oxidized starch solution.

The coating liquid was coated on a surface of a fine paper sheet having a basis weight of 48 g/m$^2$, to form a coating layer having a dry weight of 7.0 g/m$^2$, whereby a coated paper sheet was obtained.

(4) Formation of Thermosensitive Colored Image Forming Layer

A coating liquid was prepared by evenly mixing 50 parts by weight of the aqueous dye precursor dispersion A and 200 parts by weight of the aqueous color-developing agent dispersion B with 30 parts by weight of a calcium carbonate pigment, 20 parts by weight of a 25% aqueous zinc stearate dispersion, 15 parts by weight of 30% aqueous paraffin dispersion, and 100 parts by weight of a 10% aqueous polyvinyl alcohol solution, by agitating the mixture.

A surface of the pigment coated paper sheet was coated with the resultant coating liquid and dried. A thermosensitive colored image-forming layer was formed in a weight of 5.0 g/m$^2$, to provide a thermosensitive recording paper sheet.

(5) Super Calender Treatment

The recording sheet was treated by a super calender, and the calendered surface of the recording sheet had a Bekk smoothness of 900 to 1200 seconds.

(6) Whiteness Measurement and Color-Forming Test

The whiteness of the non-image-formed white portions of the recording sheet was measured by using a Hunter whiteness tester with a blue filter.

Also, the specimen of the resultant thermosensitive recording sheet was subjected to a colored image-developing test by using a dynamic color-developing tester provided by modifying a thermosensitive facsimile printer with an applied energy of 0.49 mj/dot. The resultant colored images were subjected to a measurement of a color density by a Macbeth Reflection Color Density Tester RD-914 (trademarks).

The measured color density of the colored images on the specimen is referred to as an original color density ($D_0$) of the colored images. The values of the measured whiteness and original color density are shown in Table 1.

(7) Oil Resistance Test

Specimens of the colored image-formed recording paper sheet were subjected to an oil resistance test in which salad oil was applied to the colored image-formed surface of the specimen within 30 minutes from the completion of the color-developing operation. The salad oil-applied specimen was left to stand at room temperature for 3 hours. The salad oil was wiped away from the specimen, and the color density ($D_1$) of the colored images retained on the specimen was measured by the Macbeth Reflection Color Density Tester. The measured color density is referred to as a color density ($D_1$) after oil or plasticizer resistance test.

The resistance of the colored images to the salad oil or plasticizer is represented by the color density retention ($D_1/D_0$%).

The test results are shown in Table 2.

Example 7

A thermosensitive recording sheet was produced by the same procedures as in Example 6 except that in the preparation of the dispersion B, 4,4'-bis(p-toluenesulfonylaminocarbonylamino)-3,3'dimethyldiphenylmethane was replaced by 4,4'-bis(p-toluenesulfonylaminocarbonylamino)-3,3'diethyldiphenylmethane.

The test results are shown in Table 2.

Example 8

A thermosensitive recording sheet was produced by the same procedures as in Example 6 except that in the preparation of the dispersion B, 4,4'-bis(p-toluenesulfonylaminocarbonylamino)-2,2 ', 5,5'-tetrachlorobiphenyl was employed in place of 4,4'-bis(p-toluenesulfonylaminocarbonylamino)-3,3'-dimethyldiphenylmethane, and di-p-methylbenzyl oxalate was employed in place of diphenylsulfone.

The test results are shown in Table 2.

Example 9

A thermosensitive recording sheet was produced by the same procedures as in Example 6 except that in the formation of the thermosensitive colored image-forming layer, a coating liquid was prepared by mixing 40 parts by weight of the dispersion A and 160 parts by weight of the dispersion B with 40 parts by weight of a calcium 10 carbonate pigment, 20 parts by weight of a 25% aqueous zinc stearate dispersion, 15 parts by weight of a 30% aqueous paraffin dispersion, 120 parts by weight of a 10% aqueous polyvinyl alcohol solution and 3 parts by weight of a wetting agent (Dapro U99), while stirring.

The coating solution was coated on a surface of a synthetic paper sheet (trademark: Yupo FPG 110, made by OJI Yukagoseishi K. K.) to form a thermosensitive colored image-forming layer having a dry weight of 8.5 g/m$^2$. A thermosensitive recording sheet was obtained.

The test results are shown in Table 2.

Example 10

A thermosensitive recording sheet was produced by the same procedures as in Example 6 except that in the preparation of the dispersion A, 3-(N-isopentyl-N-ethylamino)-6-methyl-7-anilinofluoran was replaced by 3-(N,N-dibutylamino)-6-methyl-7-anilinofluoran.

The test results are shown in Table 2.

Comparative Example 5

A thermosensitive recording sheet was produced by the same procedures as in Example 6 except that in the preparation of the dispersion B, 2,2-bis(4hydroxyphenyl)propane (namely bisphenol A) was employed in place of 4,4'-bis(p-toluenesulfonylaminocarbonyl-amino)-3,3'-dimethyldiphenylmethane.

The test results are shown in Table 2.

TABLE 2

| ZExample No. | Item | Whiteness (%) | Original color density ($D_0$) | Color density retention (%) |
|---|---|---|---|---|
| Example | 6 | 83.1 | 1.35 | 92 |
| | 7 | 82.6 | 1.34 | 91 |
| | 8 | 80.6 | 1.31 | 73 |
| | 9 | 84.4 | 1.37 | 94 |
| | 10 | 84.0 | 1.30 | 87 |
| Comparative Example | 5 | 77.9 | 1.44 | 17 |

Table 2 clearly indicates that the colored images formed by using the color-developing aromatic compound of the present invention (Examples 6 to 10) exhibited a significantly excellent resistance to oil in comparison with that formed by using the typical conventional color-developing compound, bisphenol A (Comparative Example 5).

Also, the thermosensitive colored image-forming layers of Example 6 to 10 had a higher whiteness than that of Comparative Example 5.

We claim:

1. A thermosensitive recording material comprising:

a substrate sheet; and a thermosensitive colored image-forming layer formed on a surface of the substrate sheet and comprising a substantially colorless dye precursor, a color-developing agent reactive with the dye precursor upon heating to thereby develop a color, and a binder, the color-developing agent comprising at least one aromatic compound: selected from the group consisting of those of the formulae (II), (III) and (IV):

$$(R^1-SO_2NH\underset{\underset{X}{\|}}{C}NH)_n-A \qquad \text{(II)}$$

in which X represents a member selected from the group consisting of oxygen and sulfur atoms, $R^1$ represents an aromatic group substituted with at least one substituent selected from the group consisting of nitro group, alkyl groups substituted with at least one halogen atom, alkyloxy groups, aryloxy groups, aralkyloxy groups, alkylcarbonyl groups, alkenyl groups, alkynyl groups, cycloalkyl groups, aryl groups and aralkyl groups, A represents a multivalent group and n represents an integer of 2 or more, $$(R^2-SO_2NH\underset{\underset{X}{\|}}{C}NH)_n-E \qquad \text{(III)}$$

in which X is as defined above, $R^2$ represents a member selected from alkyl groups, cycloalkyl groups, alkenyl groups, alkynyl groups, alkyl groups having at least one hetero atom contained in the backbone chain thereof, cycloalkyl groups having at least one hetero atom contained in the cyclic chain thereof, and alkenyl groups having at least one hetero atom contained in the backbone chain thereof, E represents a multivalent group having at least one aromatic cyclic group, and n represents an integer of 2 or more, and $$(R^3-SO_2NHC(=X)NH)_n-A \quad (IV)$$

in which X is as defined above, $R^3$ represents a member selected from the group consisting of aralkyl groups; substituted aralkyl groups having a hetero atom-containing aliphatic hydrocarbon moiety in which at least one methylene group is replaced by at least one hetero atom; substituted aralkyl groups having a substituted aromatic hydrocarbon moiety in which at least one member selected from the group consisting of substituent atoms other than hydrogen atom and substituent group is attached to an aromatic hydrocarbon moiety; and substituted aralkyl groups having a hetero atom-containing aliphatic hydrocarbon moiety in which at least one methylene group is replaced by at least one hetero atom, and a substituted aromatic hydrocarbon moiety in which at least one member selected from the group consisting of substituent atoms other than hydrogen atom and substituent groups is attached to the aromatic hydrocarbon moiety, A represents a multivalent group and n represents an integer of 2 or more.

2. The thermosensitive recording material as claimed in claim 1, wherein the aromatic compound is selected from aromatic compounds of the formula (II).

3. The thermosensitive recording material as claimed in claim 1, wherein the aromatic compound is selected from aromatic compounds of the formula (III).

4. The thermosensitive recording material as claimed in claim 3, wherein the multivalent group represented by E in the formula (III) is selected from the group consisting of:

(e) multivalent aliphatic aromatic groups derived from aliphatic hydrocarbon compounds having at least one aromatic hydrocarbon group, located in a backbone chain per molecule thereof;

(f) multivalent organic groups derived from aliphatic hydrocarbon compounds having at least one aromatic hetero-cyclic group, located in a backbone chain per molecule thereof;

(g) multivalent aromatic groups derived from aromatic hydrocarbon compounds;

(h) multivalent aromatic heterocyclic groups derived from aromatic heterocyclic compounds; and (i) multivalent organic groups derived from organic compounds in which two or more aromatic or aromatic heterocyclic groups are bonded to each other through one or more multivalent groups selected from the above-mentioned groups (a) to (d).

5. The thermosensitive recording material as claimed in claim 1, wherein the aromatic compound is selected from aromatic compounds of formula (IV).

6. The thermosensitive recording material as claimed in claim 2 or 5, wherein the multivalent group represented by A in the formulae (II) and (IV) is selected from the group consisting of:

(a) carbonyl, thiocarbonyl and sulfonyl group;

(b) multivalent aliphatic hydrocarbon groups;

(c) multivalent, hetero-atom-containing aliphatic groups derived from aliphatic hydrocarbon compounds having at least one hetero-atom located in a backbone chain per molecule thereof;

(d) multivalent aliphatic groups derived from aliphatic hydrocarbon compounds having at least one member selected from the group consisting of carbonyl, thiocarbonyl, imide, imino, and sulfonyl groups and ester structures, located in a backbone chain per molecule thereof;

(e) multivalent aliphatic aromatic groups derived from aliphatic hydrocarbon compounds having at least one aromatic hydrocarbon group, located in a backbone chain per molecule thereof;

(f) multivalent organic groups derived from aliphatic hydrocarbon compounds having at least one aromatic hetero-cyclic group, located in a backbone chain per molecule thereof;

(g) multivalent aromatic groups derived from aromatic hydrocarbon compounds;

(h) multivalent aromatic heterocyclic groups derived from aromatic heterocyclic compounds; and (i) multivalent organic groups derived from organic compounds in which two or more aromatic or aromatic heterocyclic groups are bonded to each other through one or more multivalent groups selected from the above-mentioned groups (a) to (d).

* * * * *